US007845981B2

(12) United States Patent
Vanssay et al.

(10) Patent No.: US 7,845,981 B2
(45) Date of Patent: Dec. 7, 2010

(54) SHIELDED CONNECTOR

(75) Inventors: Jean-Merri de Vanssay, Paris (FR); Emmanuel Dolley, Maisons Alfort (FR); Bertrand Dauchelle, Fontenay aux roses (FR)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 12/633,516

(22) Filed: Dec. 8, 2009

(65) Prior Publication Data

US 2010/0159744 A1 Jun. 24, 2010

(30) Foreign Application Priority Data

Dec. 18, 2008 (DE) ..... 20 2008 016 738 U

(51) Int. Cl.
*H01R 13/648* (2006.01)

(52) U.S. Cl. ..... 439/607.01; 439/567

(58) Field of Classification Search ..... 439/567, 439/607.01

See application file for complete search history.

(56) References Cited

U.S. PATENT DOCUMENTS 5,024,607 A * 6/1991 Kachlic ..... 439/567

5,797,769 A * 8/1998 Yang et al. ..... 439/571

FOREIGN PATENT DOCUMENTS

DE 20 2006 015 908 2/2007

* cited by examiner

*Primary Examiner*—Briggitte R Hammond
(74) *Attorney, Agent, or Firm*—Hayes Soloway P.C.

(57) ABSTRACT

In order to simplify the assembly of a shielded connector, it is proposed that an electrically insulating base body provided as a carrier for electric contacts features a mounting surface with two openings, wherein a recess that respectively features an integral collar on its inner side is respectively arranged around these openings.

In addition, the base body is provided with lateral fastening elements that respectively feature a window formed by a frame. The frame can be positively fitted into the appropriate recess by bending the fastening elements such that the fastening element is positively and non-positively fixed on the base body.

An electrically conductive shielding element that largely surrounds the base body contacts the fastening elements that, in turn, contact ground strips on the circuit board such that the connector is shielded from external voltages.

8 Claims, 2 Drawing Sheets

SHIELDED CONNECTOR

BACKGROUND OF THE INVENTION

1. Field of the Invention

The invention pertains to a shielded connector, particularly a D-Sub connector, comprising an electrically insulating base body that serves as a carrier for electric contacts, a metallic shielding element with a peripheral flange and two electrically conductive lateral fastening elements, wherein the base body features a mounting surface, as well as two openings that end in this mounting surface and extend through the base body.

Connectors of this type are mounted on circuit boards and serve for the electrically shielded transmission of electric signals.

2. Description of the Related Art

DE 20 2006 015 908 U1 describes a D-Sub connector with a base element, a shielding element, at least one lateral element and at least one mounting element. The mounting element serves for fastening the connector on a housing and/or for fastening a corresponding connector. The lateral element features at least one fixing element that fixes the mounting element in the mounted state of the connector.

It is furthermore disclosed that the lateral element contains at least one contact spring that is positioned in a contact spring recess in the base body in the mounted state of the lateral element. The lateral element including the contact spring is electrically conductive, wherein the contact spring contacts the shielding element in the mounted state.

It is furthermore disclosed that the lateral element features a soldering pad for being soldered to a circuit board. The shielding element preferably features a tab that engages into a tab recess provided in the base element in the mounted state. During the assembly, the tab is bent in the tab recess such that the shielding element is non-positively connected to the base element.

Connectors of this type consist of a relatively large number of different components and their manufacture requires a complicated assembly.

SUMMARY OF THE INVENTION

The invention therefore is based on the objective of disclosing a connector, particularly a D-Sub connector, that consists of the fewest different components possible and can be manufactured in a mechanized and highly cost-efficient fashion, wherein said connector still provides sufficient shielding against interfering electric fields.

This objective is attained in that a recess is respectively arranged in the mounting surface around each of the two openings, wherein this recess features a collar on its inner side, and in that the fastening elements respectively feature a window that is formed by a frame, wherein the frame is designed for being positively fitted into the respective recess.

One significant advantage of the invention can be seen in that an inventive connector can be assembled in a mechanized fashion. Such a connector can be cost-efficiently manufactured because it advantageously consists of only three different components such that the manufacture of the components required for the connector is also simplified.

The connector features a rectangular base body of an insulating material with two lateral surfaces and two end faces. The end faces contain additional to recesses that serve for fitting one respective fastening element in a gapless fashion.

The fastening element is realized in the form of a press-bent part and features a window that is formed by a frame.

In addition, a section of the fastening element is realized in the form of a U-shaped holding device. This holding device serves for fitting the fastening element into the appropriate additional recess in the corresponding end face. On its two ends, the holding device also features two arms that are angled relative to the holding device. These two arms adjoin the side of the base body that lies opposite of the mounting surface.

The holding device may contain an integral base pin for electrically contacting a ground contact of the circuit board.

A shielding element that is required for the shielding of the connector and largely encompasses the base element is provided with a peripheral flange. The longitudinal sides of this flange contain integral tabs.

These tabs are provided for non-positively connecting the shielding element to the fastening element by bending these tabs. However, the tabs also serve for producing an electrically conductive connection between the shielding element and the fastening element in the bent state.

Another advantage of the invention is that the connector has a high stability against tensile, compressive and torsional forces, particularly in the installed state, despite its simple manufacture.

In addition, a precise coplanarity of electric contacts provided on the underside of the base body is produced when the connector is mounted on the circuit board. This is achieved due to the fact that the electric contacts initially are not completely inserted into the base body, wherein the electric contacts are only inserted into the base body by the respectively required distance during the mounting on the circuit board. This is particularly important with respect to soldering the connector on a SMT circuit board. In this technique, the base pin for electrically contacting a ground contact of a circuit board is not used for mechanical reasons.

BRIEF DESCRIPTION OF THE DRAWINGS

One preferred exemplary embodiment of the invention is illustrated in the drawings and described in greater detail below. The figures show.

DESCRIPTION OF THE PREFERRED EMBODIMENTS

Figure 1:
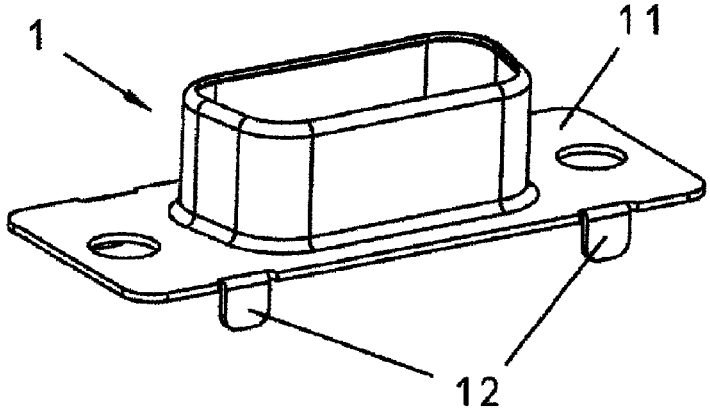
FIG. 1 is a shielding element.
Figure 2:
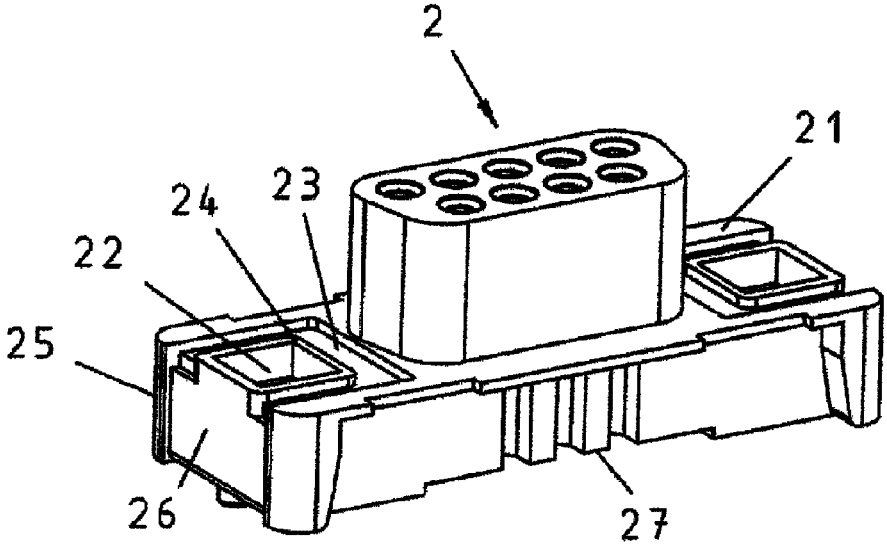
FIG. 2 is as a base body.
Figure 3:
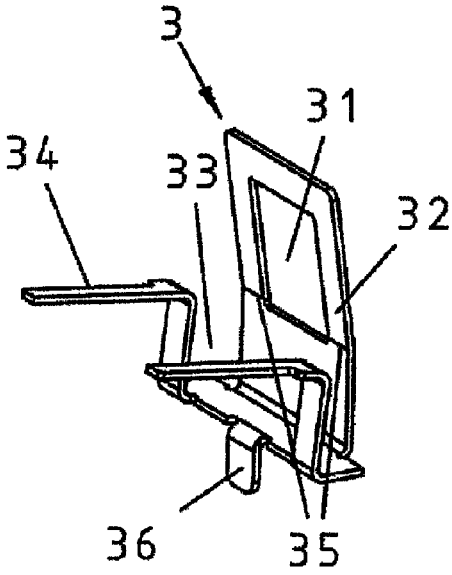
FIG. 3 is a fastening element.

A D-Sub connector comprises a shielding element 1 that is illustrated in FIG. 1, a base body 2 that is illustrated in FIG. 2 and two lateral fastening elements 3 that are illustrated individually in FIG. 3.

The shielding element 1 illustrated in FIG. 1 features a peripheral flange 11 with integral tabs 12.

The base body 2 illustrated in FIG. 2 is manufactured by means of an injection-moulding process and serves as a carrier for electric contacts, wherein this base body consists of an electrically insulating material. The base body 2 features a mounting surface 21, as well as two openings 22 that end in this mounting surface. A recess 23 with an inner collar 24 is respectively arranged in the mounting surface 21 around each of these openings 22. In addition, the base body 2 respectively features an additional recess 26 on two end faces 25. These two additional recesses 26 are provided for fitting the two fastening elements 3 in a gapless fashion.

The fastening elements 3 are illustrated individually in FIG. 3 and respectively feature a window 31 that is formed by a frame 32. In addition, the fastening elements 3 respectively feature a U-shaped holding device 32, as well as two arms 34 that are angled relative to the holding device and serve for attaching the fastening elements 3 to the base body 2.

A groove 35 is provided on the lower edge of the window 31. This groove 35 defines a bending edge for bending the fastening element 3 such that the frame 32 of the fastening element 3 attached to the base body 2 can be positively fitted into the appropriate recess 23 by means of the aforementioned bending. The fastening element 3 therefore can be fixed on the base body 2 with the aid of the U-shaped holding device 33, namely its frame 32 and the arms 34.

In addition, the fastening elements 3 respectively feature a base pin 36. This base pin 36 is provided for contacting the fastening elements 3 with a ground contact of the circuit board.

Figure 4:
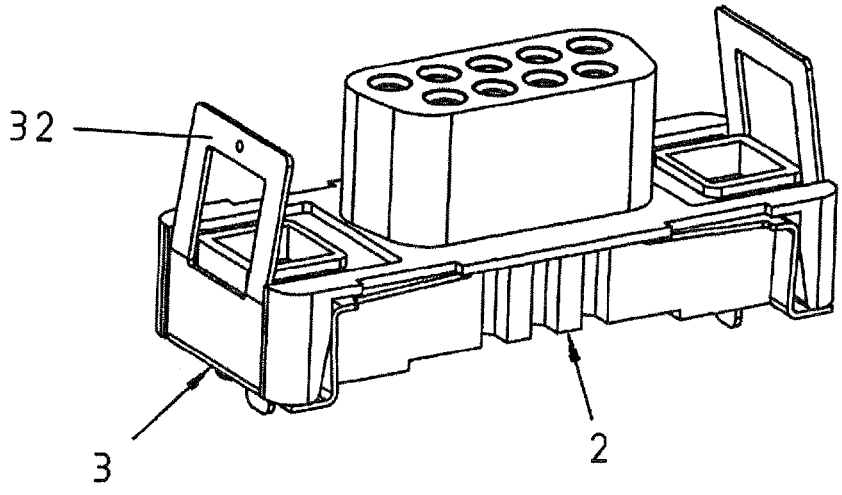
FIG. 4 is the base body with two fastening element arranged thereon.

FIG. 4 shows the base body 2 with the two fastening elements 3 attached to the end faces. In this case, the holding device of U-shaped design is fitted into the additional recess 26 in a gapless fashion. The arms 34 are simultaneously fixed on a side of the base body 2 that lies opposite of the mounting surface.

Figure 5:
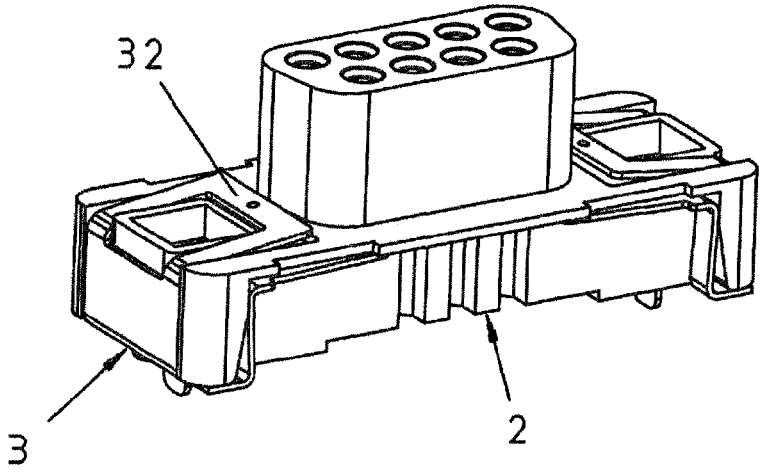
FIG. 5 is the base body with two fastening elements fixed thereon.

FIG. 5 shows the base body 2 with two fastening elements 3 that are fixed on the base body 2. For this purpose, the fastening elements 3 are positively fitted into the additional recesses 26 and the frames 32 already are largely fitted into the recesses 23 by bending the fastening elements 3 about their respective groove 35.

Figure 6:
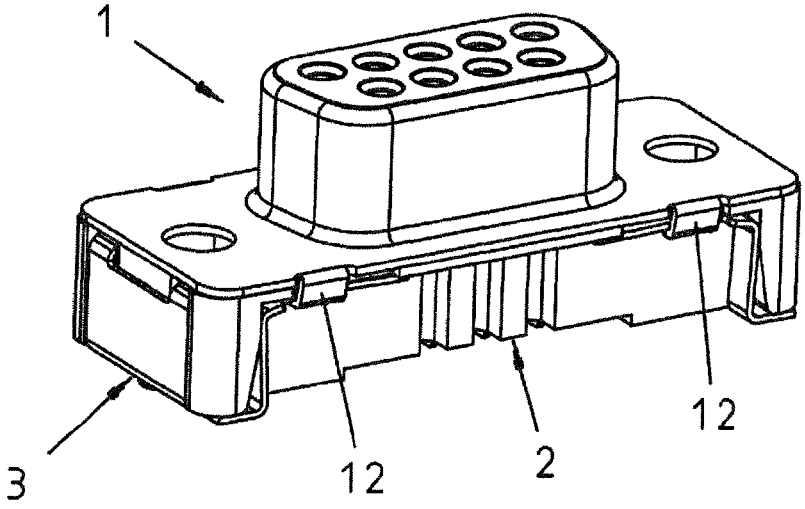
FIG. 6 is a mounted connector.

FIG. 6 shows a mounted connector. This connector consists of the base body 2 with the fixed fastening elements 3 and the attached shielding element 1. In this case, the tabs 12 of the shielding element 1 are bent in order to be non-positively connected to the respective fastening element 3 and thusly produce an electrical connection between the shielding element 1 and the respective fastening element 3.

What is claimed is:

1. A shielded connector, particularly a D-Sub connector, comprising an electrically insulating base body that serves as a carrier for electric contacts, a metallic shielding element with a peripheral flange and two electrically conductive lateral fastening elements, wherein the base body features a mounting surface, as well as two openings that end in this mounting surface and extend through the base body, wherein a recess is respectively arranged in the mounting surface around each of the two openings, wherein this recess features a collar on its inner side, and in that the fastening elements respectively feature a window that is formed by a frame, wherein the frame is designed for being positively fitted into the respective recess, wherein the shielding element features several tabs on the peripheral flange, wherein these tabs are provided for non-positively connecting the shielding element to the fastening element by bending the tabs, and wherein said tabs are also provided for producing an electrically conductive connection between the shielding element and the fastening element.

2. The connector according to claim 1, wherein the fastening elements respectively feature a holding device of U-shaped design.

3. The connector according to claim 2, wherein the ends of the shaped holding device feature two arms that are angled relative to the holding device.

4. The connector according to claim 2, wherein the U-shaped holding device features a base pin for contacting a ground contact of a circuit board.

5. A shielded connector, particularly a D-Sub connector, comprising an electrically insulating base body that serves as a carrier for electric contacts, a metallic shielding element with a peripheral flange and two electrically conductive lateral fastening elements, wherein the base body features a mounting surface, as well as two openings that end in this mounting surface and extend through the base body, wherein a recess is respectively arranged in the mounting surface around each of the two openings, wherein this recess features a collar on its inner side, and in that the fastening elements respectively feature a window that is formed by a frame, wherein the frame is designed for being positively fitted into the respective recess, and wherein the base body respectively features an additional recess on two end faces, wherein said additional recess serves for fitting the respective fastening elements in gapless fashion.

6. The connector according to Claim 5, wherein the fastening elements respectively feature a holding device of U-shaped design.

7. The connector according to claim 6, wherein the ends of the U-shaped holding device feature two arms that are angled relative to the holding device.

8. The connector according to claim 6, wherein the U-shaped holding device features a base pin for contacting a ground contact of a circuit board.

* * * * *